US006229080B1

(12) United States Patent
Ishimatsu

(10) Patent No.: US 6,229,080 B1
(45) Date of Patent: May 8, 2001

(54) MUSICAL INSTRUMENT STAND

(75) Inventor: Norihiko Ishimatsu, Hamamatsu (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 09/578,594

(22) Filed: May 25, 2000

(30) Foreign Application Priority Data

May 26, 1999 (JP) ..... 11-146205

(51) Int. Cl.[7] ..... G10D 13/02
(52) U.S. Cl. ..... 84/422.3; 84/422.1; 84/422.2
(58) Field of Search ..... 84/422.3, 422.1, 84/422.2; 248/161, 163.1

(56) References Cited

U.S. PATENT DOCUMENTS 4,449,440 * 5/1984 Hoshino ..... 84/422.3
6,003,822 * 12/1999 Kurosaki ..... 248/161

FOREIGN PATENT DOCUMENTS

4205311 * 8/1992 (DE) .
5-297863 11/1993 (JP) .
11-15466 1/1999 (JP) .

* cited by examiner

*Primary Examiner*—Shih-Yung Hsieh
(74) *Attorney, Agent, or Firm*—Ostrolenk, Faber, Gerb & Soffen, LLP

(57) ABSTRACT

A musical instrument stand such as a hi-hat stand equipped with hi-hat cymbals is basically constructed by legs (or tripod), a stand member, a pedal frame, an operation rod and a return spring. Herein, the operation rod is inserted into an internal space of the stand member, which is a pipe being vertically supported by the legs, such that the operation rod is capable of moving up and down inside of the stand member. The pedal frame is placed horizontally in connection with the stand member and is equipped with a pedal having a prescribed angle against a horizontal plane. The operation rod is normally pressed upwardly by the return spring by means of a connection member. When a performer depresses a front end of the pedal with his or her foot, the operation rod which is interlocked with the pedal by means of a transmission member is forced to move downwardly against spring force of the return spring. A spacer having a prescribed thickness is attached to a lower end of the operation rod to slightly lower the operation rod in elevation, so that the angle of the pedal is slightly reduced by a prescribed unit angle. Thus, it is possible to optimally adjust the angle of the pedal with a simple structure by adequately designing the thickness of the spacer or by changing a number of spacers being attached to the lower end of the operation rod.

9 Claims, 4 Drawing Sheets

MUSICAL INSTRUMENT STAND

BACKGROUND OF THE INVENTION

1. Field of the Invention

This invention relates to stands used for musical instruments such as drum kits, and particularly to stands of hi-hat cymbals.

This application is based on Patent Application No. Hei 11-146205 filed in Japan, the content of which is incorporated herein by reference.

2. Description of the Related Art

Musical instruments such as drum kits consisting of sets of drums and cymbals use various types of stands such as stands of hi-hat cymbals (hereinafter, referred to as "hi-hat stands"). Herein, the hi-hat stand supports hi-hat cymbals, i.e., a pair of cymbals being arranged in a face-to-face manner, as follows:

A lower fixed cymbal is mounted on a main body of the hi-hat stand. An operation rod is provided to penetrate through inside of the main body of the hi-hat stand such that it is capable of freely moving up and down. An upper moving cymbal is attached to an upper portion of the operation rod such that it is arranged opposite to face with the lower fixed cymbal. A pedal is attached to a lower portion of the operation rod such that it is interlocked with the operation rod in vertical movement. When a performer depresses the pedal with his or her foot, the operation rod correspondingly moves down so that the upper moving cymbal strikes the lower fixed cymbal to produce a cymbal sound. The operation rod is normally pressed upwardly by a return spring. So, the performer depresses down the pedal against spring force of the return spring.

FIG. 4 shows a conventional example of the hi-hat stand equipped with hi-hat cymbals being performed. That is, a hi-hat stand 1 is basically constructed by a folding tripod (or legs) 2, a hollow stand member 3, an operation rod 4, a spring device 5 and a pedal device 6. Herein, the stand member 3 is supported by the folding tripod 2 so that it stands vertically on the floor. The operation rod 4 is arranged inside of the stand member 3 to penetrate through its hollow space. So, the operation rod 4 is able to move up and down inside of the stand member 3. The spring device 5 normally presses the operation rod 4 upwardly. The pedal device 6 is attached to a lower portion of the stand member 3. A lower fixed cymbal 7 is fixed to an upper portion of the stand member 3, while an upper moving cymbal 8 is attached to an upper portion of the operation rod 4. Those cymbals 7, 8 are arranged opposite to each other in a face-to-face manner.

The spring device 5 is constructed by a pipe 9 which is fixed to an outer periphery of the lower portion of the stand member 3. In addition, it contains a return spring (not shown) which is built in the pipe 9. The return spring normally presses the operation rod 4 upwardly, so that in a non-performance mode, the upper moving cymbal 8 is located being apart from the lower fixed cymbal 7 in a vertical direction.

The pedal device 6 is constructed by a pedal frame 10, a heel 11, a pedal 12 and a transmission member 13. Herein, the pedal frame 10 has an L-shape in side view and is placed on the floor. The heel 11 is connected with a back-end portion of the pedal frame 10 in proximity to a performer. A back end of the pedal 12 is interconnected with the heel 11 such that a front end thereof is capable of freely moving up and down with rotary motion. The front end of the pedal 12 is interconnected with a lower end of the operation rod 4 by means of the transmission member 13 containing a belt and a chain. When a performer depresses down the pedal 12 with his or her foot, the operation rod 4 moves down against spring force of the spring device 5, so that the upper moving cymbal 8 strikes the lower fixed cymbal 7.

In the case of the aforementioned hi-hat stand 1, performability of the hi-hat cymbals is greatly influenced by an intersecting angle being formed between a floor surface and the pedal 12 being depressed. Because, an angle of the pedal 12 determines a stroke of the operation rod 4. So, if the angle is very large, it is difficult for the performer to play the cymbals rapidly. In addition, the performer has a difficulty in playing the cymbals and is easily get tired with movement of his or her foot. In contrast, if the angle is very small, it is difficult for the performer to operate the pedal 12 delicately.

To cope with the aforementioned drawbacks, the hi-hat stand 1 is equipped with an angle adjustment mechanism for continuously adjusting the angle of the pedal 12, an example of which is shown in FIG. 5. That is, the angle adjustment mechanism shown in FIG. 5 is constructed by a number of parts, as follows:

One end of the transmission member 13 is brought into contact with and interlocked with a roller 14 in connection with the pedal 12, while an opposite end of the transmission member 13 is fixed to a top portion of the pedal frame 10 by means of a bolt 15, a nut 16 and an elongated (or elliptical) hole 17. Herein, the opposite end of the transmission member 13 is capable of freely moving up and down within a long length of the elongated hole 17, into which the bolt 15 is inserted and is screwed with the nut 16. That is, it is possible to continuously adjust the angle of the pedal 12 in response to movement of the bolt 15 that moves along the elongated hole 17.

The aforementioned angle adjustment mechanism is fixed by a human operator (e.g., performer), as follows:

At an angle adjustment mode, the human operator loosens the nut 16 to release the bolt 15 to move up or down along the elongated hole 17. That is, the human operator moves up or down the bolt 15 along the elongated hole 17 to set a desired angle for the pedal 12. Then, the human operator tightens the nut 16 to fix the bolt 15 to the elongated hole 17 at a prescribed position.

As described above, the conventional angle adjustment mechanism is disadvantageous in that it needs complicated adjustment work by use of a specific tool such as a wrench (or a spanner). In addition, there is a problem in which if the nut 16 goes loosened by vibrations being applied to the hi-hat stand 1 during performance, the bolt 15 is released to move along the elongated hole 17 so that the angle of the pedal 12 is varied unintentionally.

SUMMARY OF THE INVENTION

It is an object of the invention to provide a musical instrument stand such as a hi-hat stand which has a simple structure to support hi-hat cymbals and in which an angle of a pedal is easily adjusted without using a special tool.

A musical instrument stand of this invention such as a hi-hat stand equipped with hi-hat cymbals is basically constructed by legs (or tripod), a stand member, a pedal frame, an operation rod and a return spring. Herein, the operation rod is inserted into an internal space of the stand member, which is a pipe being vertically supported by the legs, such that the operation rod is capable of moving up and down inside of the stand member. The pedal frame is placed horizontally in connection with the stand member and is equipped with a pedal having a prescribed angle against a horizontal plane. A connection member is provided to connect a lower end of the operation rod with one end of the return spring so that the operation rod is normally pressed upwardly by the return spring. In addition, a transmission member is provided to interconnect the lower end of the operation rod with a front end of the pedal. When a performer depresses the front end of the pedal with his or her foot, the operation rod is forced to move downwardly against spring force of the return spring.

This invention is characterized by providing a specially designed spacer having a prescribed thickness, which is attached to the lower end of the operation rod to slightly lower the operation rod in elevation so that the angle of the pedal is slightly reduced by a prescribed unit angle. Herein, the unit angle depends upon the thickness of the spacer. It is possible to additionally attach a felt member to the lower end of the operation rod together with the spacer to reduce mechanical noise. Thus, it is possible to optimally adjust the angle of the pedal with a simple structure by adequately designing the thickness of the spacer or by changing a number of spacers being attached to the lower end of the operation rod.

The spacer is made of elastic material and is formed in a C-shape having an elongated hole consisting of a circular center hole whose diameter is slightly larger than an outer diameter of the operation rod and a cut portion corresponding to a channel which provides communication between the circular center hole and an outer periphery of the spacer and whose width is slightly smaller than the outer diameter of the operation rod. When the spacer is attached to the lower end of the operation rod, the spacer is elastically deformed in its diameter direction so that the operation rod is inserted into the circular center hole by way of the cut portion.

BRIEF DESCRIPTION OF THE DRAWINGS

These and other objects, aspects and embodiments of the present invention will be described in more detail with reference to the following drawing figures, of which.

DESCRIPTION OF THE PREFERRED EMBODIMENTS

This invention will be described in further detail by way of examples with reference to the accompanying drawings.

[A] First Embodiment

Figure 1:
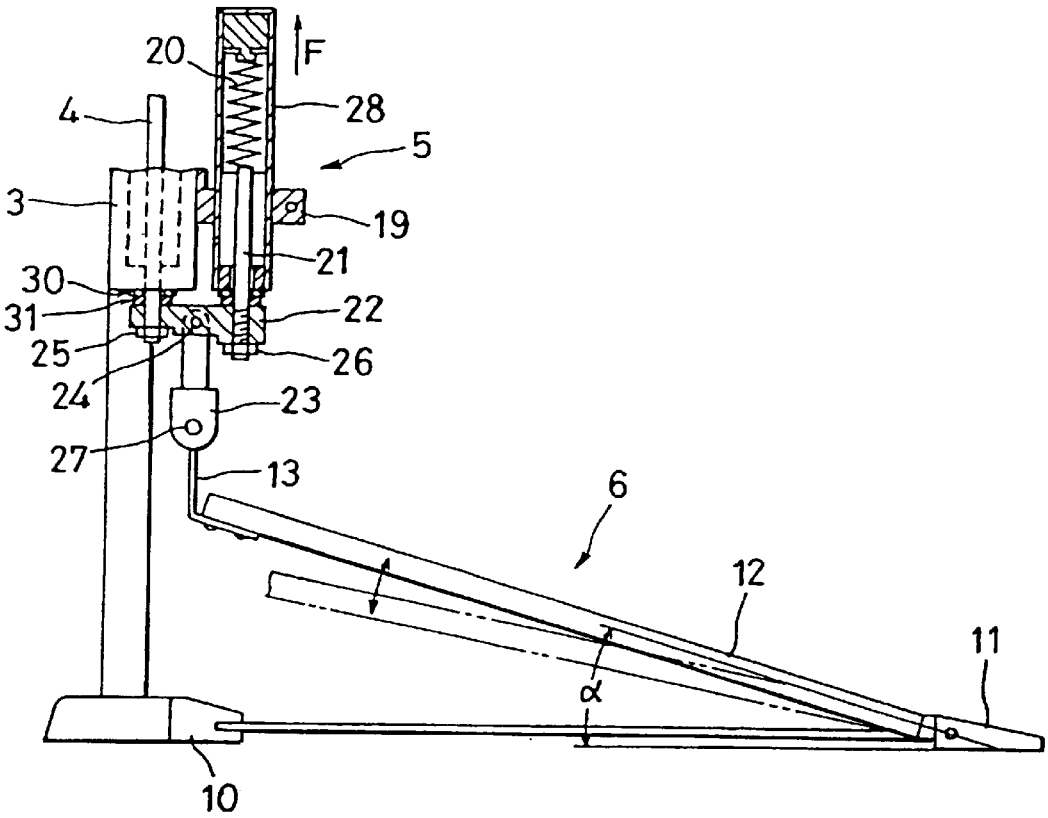
FIG. 1 is a side view partly in section showing essential parts of a hi-hat stand in accordance with a first embodiment of the invention.
Figure 2:
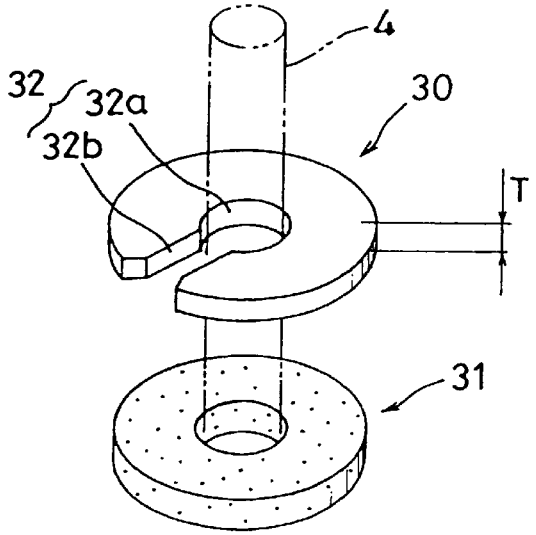
FIG. 2 is a perspective view showing a spacer and a felt member used for pedal angle adjustment.
Figure 4:
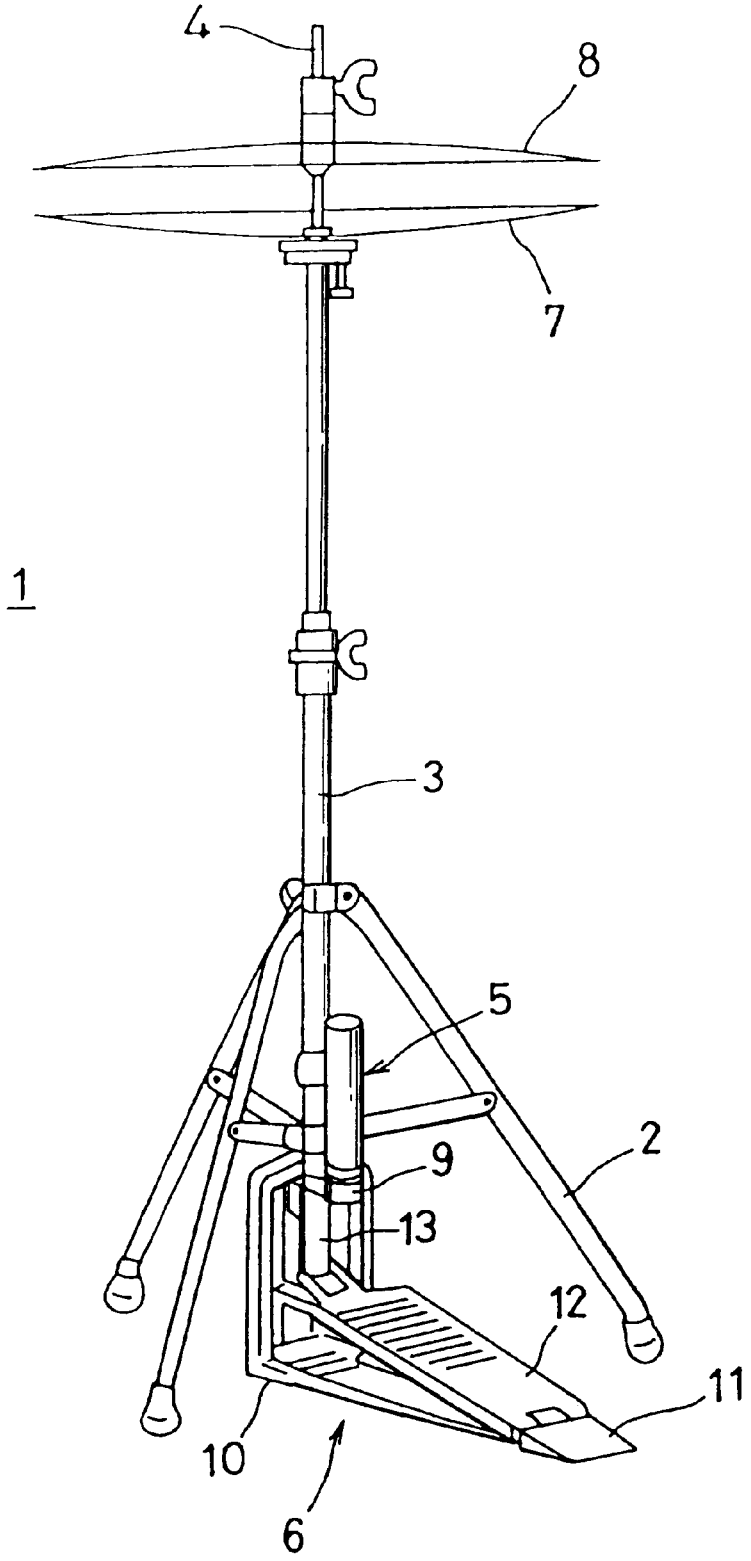
FIG. 4 is a perspective view showing a conventional example of a hi-hat stand equipped with hi-hat cymbals.
Figure 5:
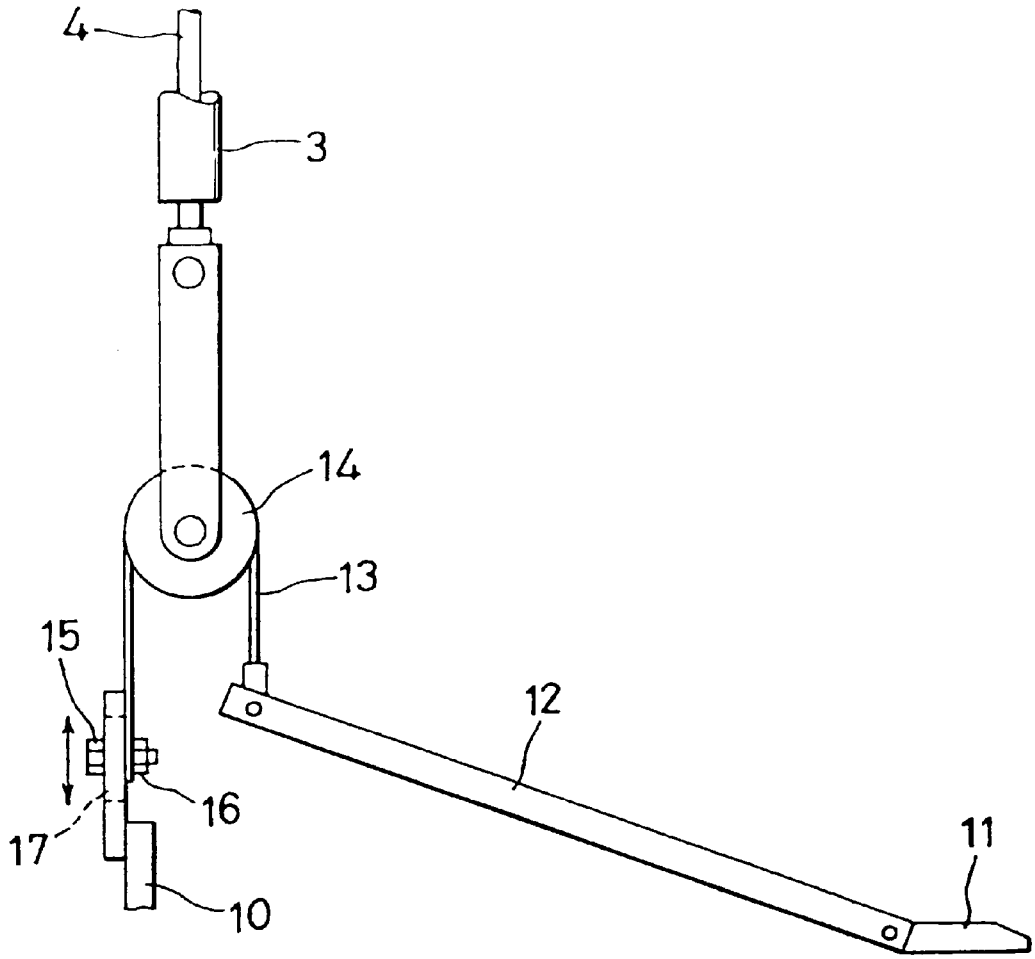
FIG. 5 (PRIOR ART)
FIG. 5 is a side view showing a conventional example of an angle adjustment mechanism used for adjusting an angle of a pedal of the hi-hat stand of FIG. 4.

FIG. 1 is a side view partly in section showing essential parts of a musical instrument stand in accordance with a first embodiment of the invention. FIG. 2 is a perspective view showing a spacer and a felt member, which are used for pedal angle adjustment. In FIGS. 1 and 2, parts equivalent to those shown in FIGS. 4 and 5 are designated by the same reference numerals, hence, the description thereof will be omitted. Concretely speaking, the first embodiment shows an example of a hi-hat stand (see FIG. 4) in which a spring device 5 for normally pressing up an operation rod 4 is arranged in proximity to an outer periphery of a lower end of a stand member 3.

The spring device 5 used for the first embodiment is basically similar to one used in the conventional hi-hat stand 1 shown in FIG. 4. That is, the spring device 5 is constructed using a pipe 28, which is fixed to the outer periphery of the lower end of the stand member 3 by way of a bracket 19 and in which a return spring 20 and a spring rod 21 are arranged. Herein, an upper end of the return spring 20 is interconnected with a closed top portion of the pipe 28. In addition, the spring rod 21 is inserted into the pipe 28 from its lower end portion, so that an upper end thereof is interconnected with a lower end of the return spring 20. Further, a lower end of the spring rod 21 is interconnected together with a lower end of the operation rod 4 by means of a connection member 22.

A center portion of the connection member 22 in its length direction is pivotally supported by a shaft 24, which is arranged horizontally and is attached to an upper end of a joint 23. So, the connection member 22 is capable of freely rotating about the shaft 24. The lower end of the operation rod 4 penetrates through a left end of the connection member 22, so that it is fixed to the left end of the connection member 22 by a nut 25. In addition, the lower end of the spring rod 21 penetrates through a right end of the connection member 22, so that it is fixed to the right end of the connection member 22 by a nut 26. One end of a transmission member 13 is fixed to a front-end portion of a pedal 12. Another end of the transmission member 13 is interconnected with a lower end of the joint 23 by means of a pin 27.

A pair of a spacer 30 and a felt member 31 are arranged between a lower surface of the stand member 3 and an upper surface of the left portion of the connection member 22. The spacer 30 and the felt member 31 are used for adjusting a pedal angle. Incidentally, it is possible to further arrange a pair of the space and felt member between a lower surface of the spring device 5 and a upper surface of the right portion of the connection member 22.

As shown in FIG. 2, the spacer 30 is made of synthetic resin material, or it is made using a metal plate. The spacer 30 as a whole is formed in a prescribed shape such as a C-shape in plan view. In addition, the spacer 30 has an elongated hole 32, which can be elastically deformed in a diameter direction and which is elongated from a center to an outer periphery thereof Namely, the elongated hole 32 consists of a circular center hole 32*a*, which is formed at the center of the spacer 30, and a cut portion 32*b* which extends linearly from the center to the outer periphery of the spacer 30. So, the cut portion 32*b* provides a communication channel between the circular center hole 32*a* and the outer periphery of the spacer 30. A diameter of the circular center hole 32*a* is set larger than an outer diameter of the lower end of the operation rod 4. In addition, a width of the channel (or channel width) of the cut portion 32*b* is set slightly smaller than the outer diameter of the lower end of the operation rod 4. An open end of the cut portion 32*b* at the outer periphery of the spacer 30 is formed with taper surfaces or round surfaces, which enable easy installation of the operation rod 4 into the circular center hole 32*a* of the spacer 30.

The lower end of the operation rod 4 is detachably inserted into the spacer 30 from its side direction, as follows:

A human operator pulls down the operation rod 4 against the upward spring force of the spring device 5 to provide a gap, which is larger than a thickness T of the spacer 30, between the lower surface of the stand member 3 and the upper surface of the connection member 22. In this state, the human operator moves the spacer 30 horizontally such that the open end of the cut portion 32*b* is pressed against an exterior peripheral surface of the lower end of the operation rod 4. Thus, the spacer 30 is elastically deformed in its diameter direction by the operation rod 4, so that the cut portion 32*b* is broadened in its width direction. The human operator further presses the operation rod 4 to the spacer 30, so that the operation rod 4 is inserted into the circular center hole 32*a* by way of the "broadened" cut portion 32*b*. When the operation rod 4 is completely inserted into the circular center hole 32*a*, the spacer 30 is elastically restored in an original shape thereof. Thus, it is possible to complete installation (or insertion) of the operation rod 4 in the spacer 30. Once the operation rod 4 is completely inserted into the spacer 30, the spacer 30 is not easily detached or dropped from the operation rod 4 because the channel width of the cut portion 32*b* is smaller than the outer diameter of the operation rod 4.

The felt member 31 is formed in a ring shape and is attached to the lower end of the operation rod 4 in advance by assembly of the hi-hat stand. However, the felt member 31 is not necessarily formed in the ring shape. For example, it is possible to form the felt member 31 in a C-shape as similar to the spacer 30. In that case, the felt member 31 is detachably attached to the operation rod 4 from its side direction together with the spacer 30. In addition, the first embodiment is basically designed to use a single felt member. Of course, it is possible to modify the first embodiment to be equipped with two felt members. In that case, the spacer is sandwiched between the two felt members, so it is possible to avoid a direct contact between the spacer 30 and the stand member 3 or the connection member 22. Thus, it is possible to considerably reduce mechanical noise being produced due to the direct contact between them. Incidentally, it is possible to eliminate the felt member 31 by adhering noise absorption members (such as rubber materials) to front and back surfaces of the spacer 30.

In the hi-hat stand of the first embodiment described above, when the spacer 30 is attached to the lower end of the operation rod 4 from its side direction, the operation rod 4 is lowered in elevation by the thickness T of the spacer 30. In other words, it is possible to reduce an angle of the pedal 12 by a certain angle $\alpha$ which corresponds to the thickness T of the spacer 30. It is possible to increase a number of spacers, which are sequentially attached to the lower end of the operation rod 4 and are piled up in elevation between the lower surface of the stand member 3 and the upper surface of the connection member 22. In this case, every time the number of the spacers being attached to the lower end of the operation rod 4 is increased by one, it is possible to reduce the angle of the pedal 12 by a unit angle $\alpha$. Incidentally, it is possible to provide multiple types of spacers, which differ from each other in thickness and which are adequately combined together. In that case, it is possible to perform angle adjustment of the pedal 12 in an optimal manner by using an optimal combination of the spacers.

Accordingly, it is unnecessary for the human operator to use a special tool for installation of the spacer(s) 30 with the operation rod 4. In addition, it is unnecessary for the human operator to perform troublesome operations such as tightening the nut and removing the operation rod 4 from the stand member 3. So, the first embodiment provides an easy method for the angle adjustment of the pedal 12.

Further, the first embodiment merely requires multiple spacers 30 being prepared in advance without modification of the hi-hat stand in structure and without using tools for angle adjustment. Thus, the angle adjustment of the pedal 12 can be easily performed with a simple structure. The spacer can be applied to any other types of musical instrument stands, which are manufactured by other factories or companies, as long as their operation rods have prescribed dimensions, particularly prescribed outer diameters.

[B] Second Embodiment

Figure 3:
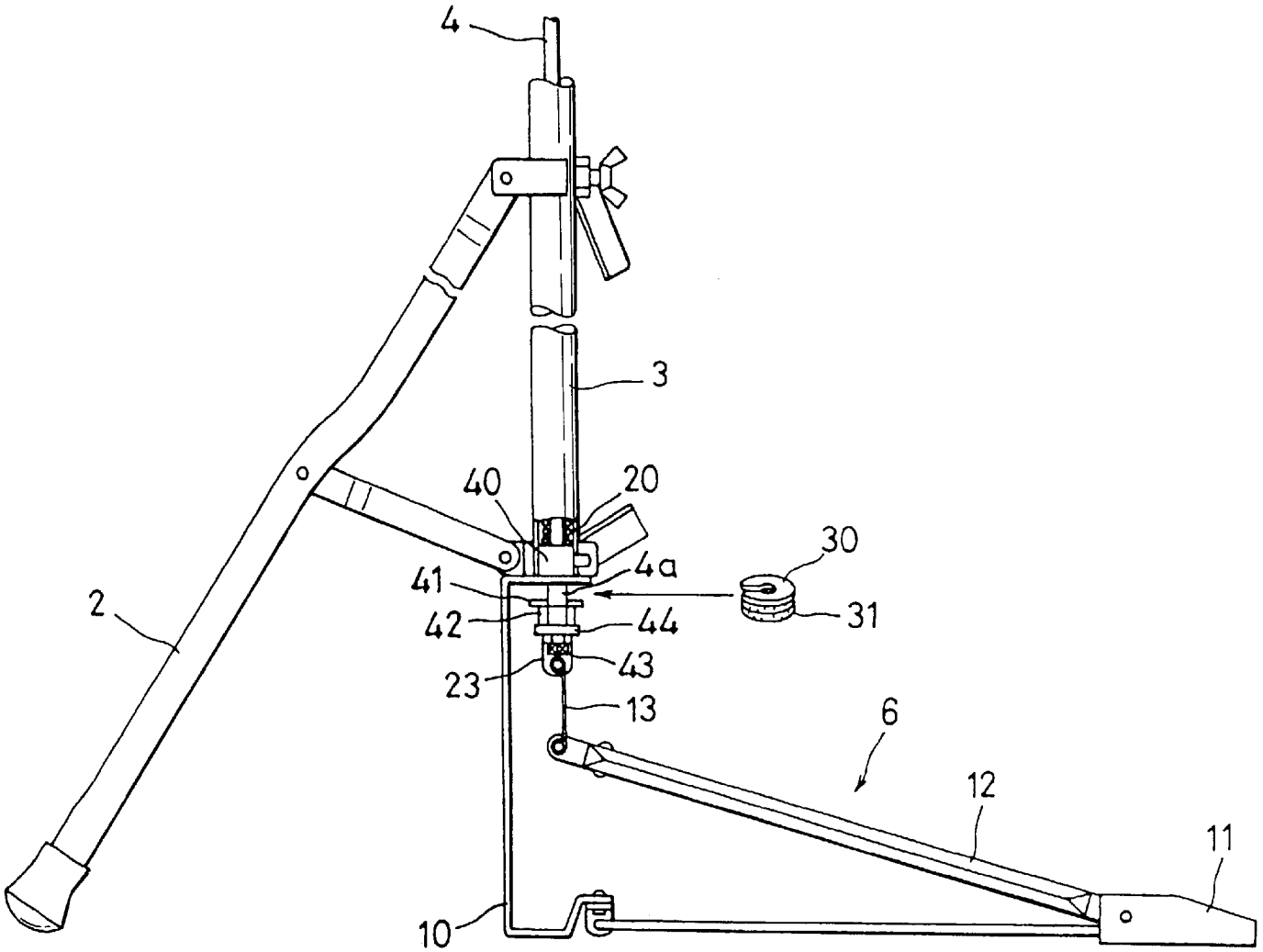
FIG. 3 is a side view partly in section showing essential parts of a hi-hat stand in accordance with a second embodiment of the invention.

FIG. 3 is a side view partly in section showing essential parts of a hi-hat stand in accordance with a second embodiment of the invention, wherein parts equivalent to those of the first embodiment will be designated by the same reference numerals, hence, the description thereof will be omitted. Herein, the hi-hat stand is constructed such that a return spring 20 is built in a stand member 3.

In FIG. 3, the hi-hat stand is equipped with a bush 40, a washer 41, nuts 42, 43 and a joint felt 44. Herein, the washer 41 and the nut 42 are engaged with the lower end of the operation rod 4 at selected positions above the joint 23.

As similar to the first embodiment, the second embodiment is basically designed such that angle adjustment of the pedal 12 is made by a human operator who pulls down the operation rod against spring force of the return spring 20 built in the stand member 3. In the second embodiment, when the operation rod 4 is lowered in elevation, the washer 41 is correspondingly lowered to be apart from a lower surface of the stand member 3 so that a rod portion 4*a* (i.e., lower end) of the operation rod 4 appears between the washer 41 and the stand member 3. Then, a pair of a spacer 30 and a felt member 31 are attached to the rod portion 4*a* of the operation rod 4. Herein, the spacer 30 shown in FIG. 3 has a same shape of the spacer 30 shown in FIG. 2. In addition, the felt member 31 shown in FIG. 3 is also formed in the same shape of the spacer 30. That is, the felt member 31 has a C-shape containing an elongated hole that extends in its radius direction. Therefore, the felt member 31 is detachably attached to the lower end of the operation rod 4 together with the spacer 30.

In the second embodiment, the spacer 30 and the felt member 31 are attached to the lower end of the operation rod 4 from its side direction. As similar to the first embodiment, the second embodiment is capable of adjusting the angle of the pedal 12 with ease.

Lastly, both of the aforementioned embodiments are related to the hi-hat stand as an example of the musical instrument stand. Of course, this invention is not necessarily limited to those embodiments, hence, this invention is applicable to any other types of musical instrument stands each of which is equipped with the pedal device 6.

As described heretofore, this invention has a variety of technical features and effects, which are summarized as follows:

(1) The musical instrument stand (e.g., hi-hat stand) of this invention is basically design to enable pedal angle adjustment by using a spacer (or spacers) which is detachably attached to a lower end of an operation rod. So, this invention provides a simple structure for the pedal angle adjustment without using a special tool. In addition, the spacer is designed not to be easily detached from the operation rod by vibrations being applied to the hi-hat stand whose hi-hat cymbals are performed. Further, this invention does not require modification of the musical instrument stand in structure. Furthermore, this invention does not need special parts for the pedal angle adjustment other than the spacer. Thus, this invention is applicable to any other types of musical instrument stands, which are manufactured by other factories or companies.

(2) Concretely speaking, it is possible to gradually adjust an angle of the pedal interlocked with the operation rod which is lowered in elevation by the spacer. Herein, it is possible to increase a number of spacers being attached to the lower end of the operation rod. So, it is possible to adjust the angle of the pedal in a step-by-step manner by changing the number of the spacers.

(3) The spacer is basically formed in a C-shape in plan view, i.e., a circular shape one part of which is cut to form an elongated hole consisting of a circular center hole and a cut portion. Herein, the circular center hole has a diameter which is larger than an outer diameter of the operation rod, while the cut portion is a channel which provides communication between the circular center hole and outer periphery of the spacer and whose width is slightly smaller than the outer diameter of the operation rod. When a human operator presses the spacer to the lower end of the operation rod, the spacer is elastically deformed to broaden the cut portion in its width so that the operation rod is inserted into the circular center hole of the spacer by way of the broadened cut portion. After the operation rod is completely inserted into the circular center hole of the spacer, the spacer is restored in its original shape. This prevents the spacer from being easily detached or dropped from the operation rod.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds are therefore intended to be embraced by the claims.

What is claimed is:

1. A musical instrument stand comprising:

a stand member which is supported vertically on a pedal frame;

an operation rod which is inserted in an interior space of the stand member such that the operation rod is capable of freely moving up and down inside of the stand member;

a return spring which normally presses the operation rod upwardly;

a pedal being interlocked with a lower end of the operation rod by means of a transmission member;

a plurality of legs which support the stand member together with the pedal frame; and a spacer which is detachably attached to the lower end of the operation rod, which projects downwardly from a lower surface of the stand member, so that an angle of the pedal is being adjusted by attaching the spacer to the lower end of the operation rod.

2. A musical instrument stand according to claim 1 wherein the spacer is made of a material that allows elastic deformation and is formed in a prescribed shape basically corresponding to a circular shape whose one end is cut to form an elongated hole consisting of a circular center hole and a cut portion, and wherein the circular center hole is formed at a center of the spacer to have a diameter being slightly larger than an outer diameter of the operation rod, while the cut portion corresponds to a channel which provide communication between the circular center hole and an outer periphery of the spacer and whose width is slightly smaller than the outer diameter of the operation rod, so that the spacer is elastically deformed in its diameter direction when the operation rod is pressed into the circular center hole by way of the cut portion.

3. A musical instrument stand according to claim 1 further comprising a felt member which is attached to the lower end of the operation rod together with the spacer.

4. A musical instrument stand according to claim 2 further comprising a felt member which is attached to the lower end of the operation rod together with the spacer.

5. A musical instrument stand according to claim 1 wherein the plurality of legs are actualized by a tripod.

6. A musical instrument stand according to claim 1 wherein the stand member is equipped with hi-hat cymbals on an upper portion thereof.

7. A hi-hat stand equipped with hi-hat cymbals, comprising:

a tripod;

a stand member corresponding to a pipe which is vertically supported by the tripod;

a pedal frame which is placed horizontally in connection with the stand member being vertically supported and which is equipped with a pedal having an angle against a horizontal plane of the pedal frame;

an operation rod which is inserted into an internal space of the stand member such that the operation rod is capable of moving up and down inside of the stand member;

a return spring having a spring force;

a connection member for connecting a lower end of the operation rod with one end of the return spring so that the operation rod is normally pressed upwardly by the spring force of the return spring;

a transmission member for transmitting depression of the pedal to the lower end of the operation rod, so that when a front end of the pedal is depressed, the operation rod is forced to move down correspondingly by means of the transmission member; and a spacer having a prescribed thickness, which is attached to the lower end of the operation rod to slightly lower the operation rod in elevation against the spring force of the return spring, so that the angle of the pedal interlocked with the operation rod is slightly reduced by a prescribed unit angle corresponding to the prescribed thickness of the spacer, wherein the spacer is made of elastic material and is formed in a C-shape having an elongated hole consisting of a circular center hole whose diameter is slightly larger than an outer diameter of the operation rod and a cut portion corresponding to a channel which provides communication between the circular center hole and an outer periphery of the spacer and whose width is slightly smaller than the outer diameter of the operation rod, and wherein when the spacer is pressed to the lower end of the operation rod, the spacer is elastically deformed in its diameter direction so that the operation rod is inserted into the circular center hole by way of the cut portion.

8. A hi-hat stand according to claim 7 wherein the cut portion of the elongated hole of the spacer is formed with taper surfaces or round surfaces to provide easy insertion of the operation rod.

9. A hi-hat stand according to claim 7 further comprising a felt member which is attached to the lower end of the operation rod together with the spacer.

* * * * *